United States Patent [19]

Yin et al.

[11] Patent Number: 4,587,913

[45] Date of Patent: May 13, 1986

[54] AUTOMATIC SEWING APPARATUS

[75] Inventors: Chieh-Kung Yin, Hawthornwoods; Maximilian Adamski, Barrington, both of Ill.

[73] Assignee: Union Special Corporation, Chicago, Ill.

[21] Appl. No.: 721,013

[22] Filed: Apr. 8, 1985

[51] Int. Cl.[4] ..... D05B 19/00; D05B 21/00

[52] U.S. Cl. ..... 112/262.3; 112/121.11; 112/304; 270/56

[58] Field of Search ..... 112/262.3, 262.1, 121.11, 112/121.12, 121.15, 303, 304, 306, 121.14, 2; 270/56, 53

[56] References Cited

U.S. PATENT DOCUMENTS

| | | | |
|---|---|---|---|
| 4,444,384 | 4/1984 | Keeton | 271/18.3 |
| 4,499,834 | 2/1985 | Ruetschle et al. | 112/121.11 X |
| 4,530,295 | 7/1985 | Adamski et al. | 112/121.12 |

*Primary Examiner*—H. Hampton Hunter

*Attorney, Agent, or Firm*—John A. Schaerli

[57] ABSTRACT

A method and apparatus are provided for automatically sewing an advancing workpiece. To facilitate subsequent sewing operations, the workpiece length is calculated as the workpiece moves along its predetermined path of travel. If the advancing workpiece length lies within a preselected range of sizes, the workpiece will continue to move along its predetermined path. Should the workpiece length be calculated to be outside the preselected range of sizes, the workpiece is rejected from the predetermined path of travel.

12 Claims, 4 Drawing Figures

AUTOMATIC SEWING APPARATUS

FIELD OF THE INVENTION

The present invention relates to automatic sewing machines and, more particularly, to a method and apparatus for automatically calculating the length of an advancing workpiece and removing same from its predetermined path of travel if such workpiece fails to fall within a preselected range of sizes.

BACKGROUND OF THE INVENTION

An article of clothing manufacture is often comprised of more than one piece. A T-shirt, for example, includes a body portion and two sleeve portions. Each portion of the clothing article is seperately produced and then secured together in subsequent operations. Because many of today's sewing operations are automatically performed, 100% inspection of the individual pieces comprising the end article is not always achieved. As a result, faulty workpieces are, at times, erroneously used in the final sewing operation. Once sewn into the final product, however, the faulty portion of the workpiece is very difficult, if not impossible, to correct. Therefore, the entire end product must be rejected.

The teachings of U.S. patent application Ser. No. 505,671, filed June 20, 1983 and entitled "AUTOMATIC SLEEVE MAKING", suggests an automatic apparatus for producing T-shirt sleeves. In such a device, the workpiece blank is: advanced along a predetermined path by a first conveyance means; its marginal edge is hemmed; the workpiece is automatically folded and transferred to a second conveyance means; and, finally, the folded edges are closed to form a sleeve.

With such a device, the blanks presented to the first conveyance means may be of varying sizes depending on the way they were cut, loaded on the conveyor, bundled and etc. Should the workpiece length be too long, its transference to the second conveyance means may be hindered. Accordingly, subsequent problems may result. Should the workpiece be too short, the folded edges may be only partially closed. The problems inherent with securing a partially closed sleeve into a T-shirt body are apparent. As mentioned, to correct such deficiencies requires time and sacrifices productivity. Accordingly, there is a valuable need for means which may avoid such problems.

SUMMARY OF THE INVENTION

Because of the above, and in accordance with the present invention, there is provided an automatic apparatus including means for calculating the length of the workpiece as it advances along a predetermined path and means for rejecting the workpiece from the predetermined path when the length of said workpiece is calculated to be outside a predetermined or preselected range of sizes. In such manner, each workpiece advancing along the predetermined path will be monitored and only those meeting the proper criteria will be allowed to continue toward subsequent operations.

The apparatus for effecting these ends includes a first material conveyance means for sequentially advancing individual sheets of material along a predetermined path of travel. As the workpiece advances along its predetermined path, the workpiece length is calculated. A sensor means for detecting the leading and trailing ends of the workpiece forms part of the means for calculating the workpiece length. Means for measuring the linear displacement of the blank during the interim between the detection of the leading and trailing workpiece ends is also provided as part of such workpiece length calculation means. The output of the sensor means and the means for measuring the linear displacement of the workpiece are electronically processed whereby calculating the length of the workpiece. The workpiece length is then electronically compared to a preselected range of sizes which would be allowed to produce an acceptable workpiece. Should the calculated length of the workpiece lie within the preselected range of sizes, the workpiece is allowed to continue along a predetermined path. On the other hand, should the calculated length of the workpiece lie outside the preselected range of sizes, the workpiece is rejected from the predetermined path so as to prevent the introduction of a faulty workpiece component to the assembled garment.

In line with the above, a primary object of the present invention is to improve automatic sewing systems by detecting the nonconformity of a workpiece to a particular range of sizes.

Another object of the invention is to provide, in combination, means for advancing workpieces along a predetermined path with means for rejecting such workpieces from the predetermined path when the length of such workpiece is calculated to be outside a predetermined range of sizes.

It is a further object of this invention to provide an apparatus for calculating the length of a workpiece moving along a conveyor in a predetermined path and for eliminating further work on said workpiece unless the workpiece meets certain predetermined criteria.

BRIEF DESCRIPTION OF THE DRAWINGS

Having in mind the above ojects and other attendent advantages that will be evident from an understanding of the disclosure, the invention comprises the devices, combinations, and arrangement of parts as illustrated in the presently preferred form of the invention which is hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
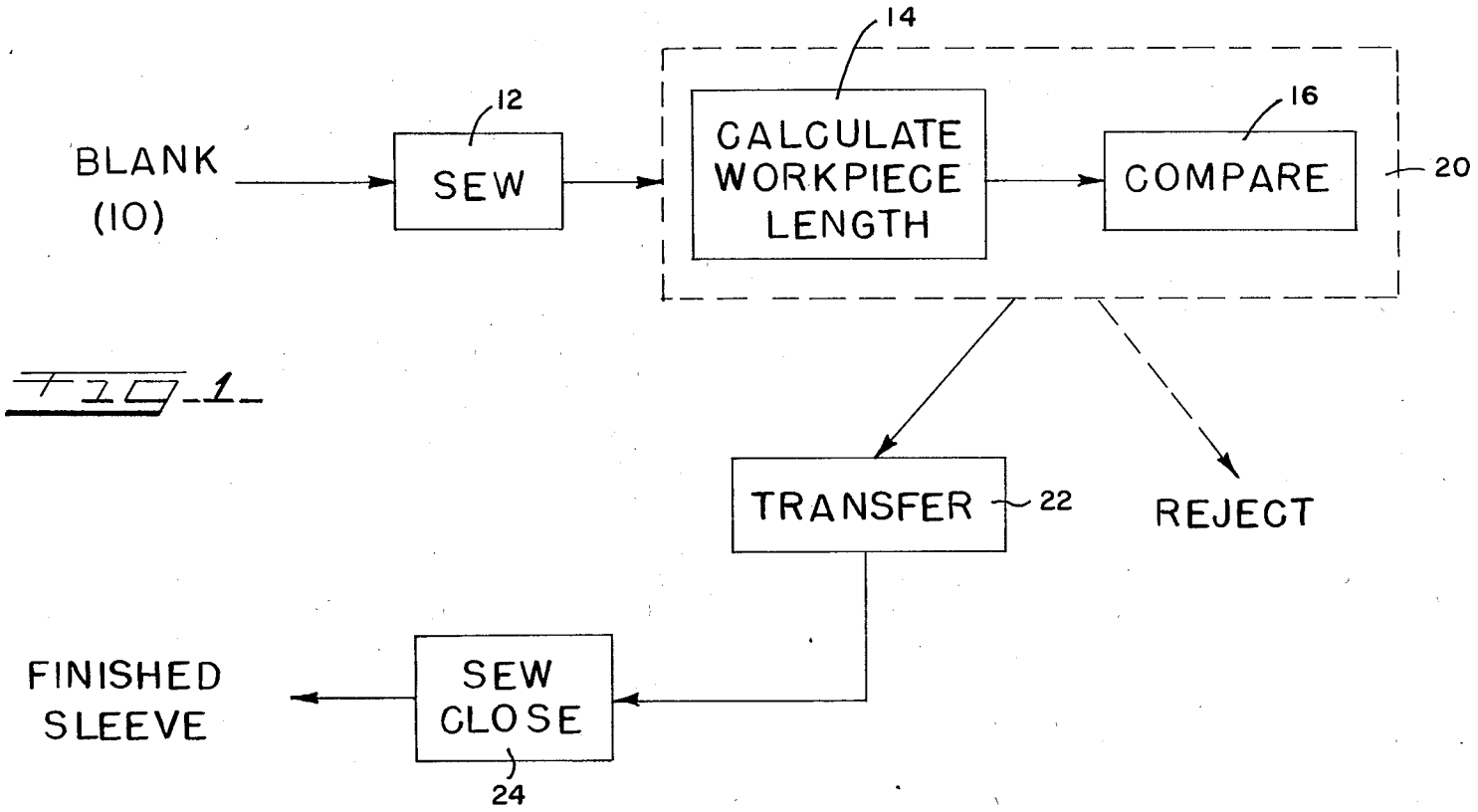
FIG. 1 is a schematic illustrating various stages in the production of a workpiece according to the present invention.

FIG. 1 schematically illustrates the general practice of the present invention. The blank or fabric piece 10 is automatically advanced along a predetermined path to a sewing station 12 whereat the marginal edge of the blank may be operated upon. In the preferred embodiment, the workpiece length is then calculated as at 14 by means to be subsequently described. The electronically processed workpiece length data is then compared against the preselected range of sizes as at 16. If the workpiece length lies within the preselected range of sizes, a control system 20 permits the workpiece to be advanced further along the predetermined path by a transfer mechanism 22. Once transferred, the workpiece is sewn closed as at a sewing station 24 and a finished sleeve results. On the other hand, should the workpiece lie outside the preselected range of sizes, the control system 20 causes the workpiece to be rejected from its predetermined path of travel and no further operations are performed thereon.

The details of an exemplary apparatus for practicing the method described above is illustrated in FIGS. 2 through 4. In the various FIGURES of the drawings, there is schematically illustrated a sewing apparatus including a material delivery or supply system 26. The delivery or supply system includes a generally L-shaped frame 28 each leg of which is provided with endless conveyance means 30 and 32. The conveyance means 30 is adapted to move a workpiece or material sheet W in a first generally horizontal direction between a loading position or point, generally designated 34, to a second position or workpiece pickup point, generally designated 36. The other conveyance means 32 is adapted to move the workpiece in a second seperate direction. Each conveyance means moves the workpiece along elongated planar paths and comprises a series of laterally spaced endless belts which serve as movable support surface means for the workpiece.

A workpiece transfer or conveyance means 22 of the type disclosed in U.S. application Ser. No. 545,806, filed Oct. 26, 1983 by Robert L. Kosrow and entitled "AUTOMATIC TRANSFER APPARATUS" (the full disclosure of which is incorporated herein by reference) is disposed at the interface of the conveyor means 30 and 32. The transfer mechanism means 22 is adapted to sequentially engage and move individual workpieces from the workpiece pickup point 36 to a location disposed further along the predetermined pathway and extending parallel with the first conveyance means. That is, the conveyance means 30 moves the workpiece for a portion of its travel along the predetermined pathway and the conveyance means 22 moves the workpiece for the remainder of its movement along the predetermined pathway.

Figure 2:
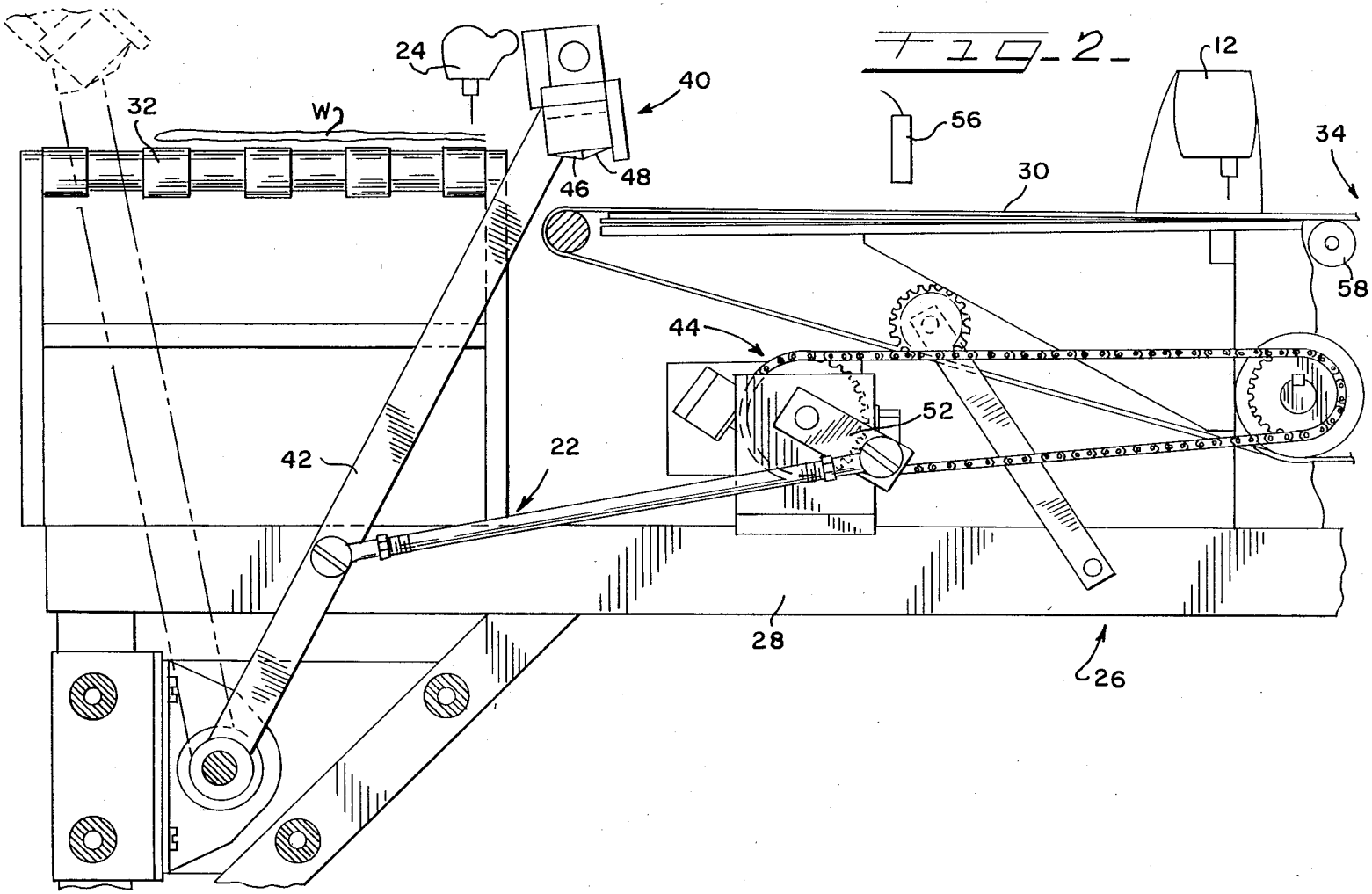
FIG. 2 is a partial side schematic view of an apparatus incorporating the present invention.
Figure 3:
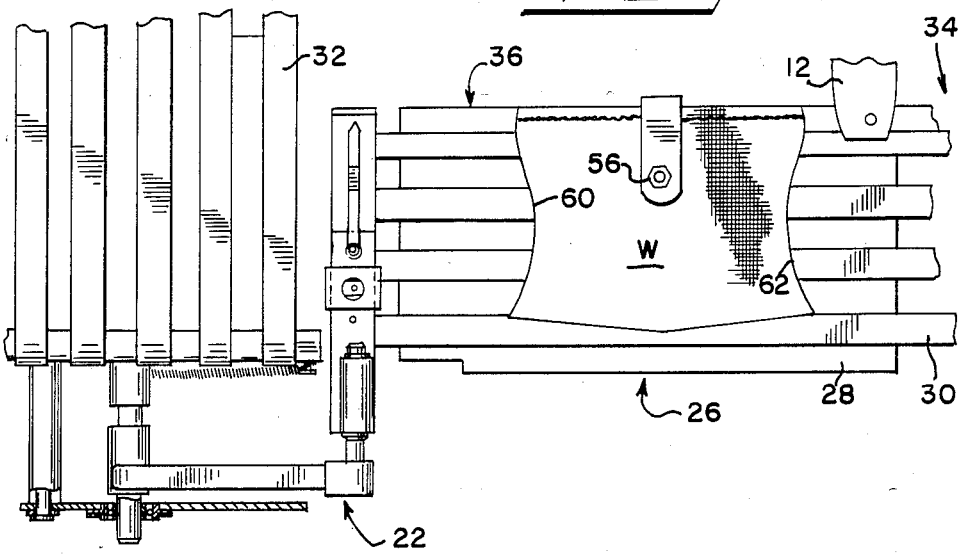
FIG. 3 is a partial top plan view of the apparatus shown in FIG. 2.

The primary operative elements of the transfer or conveyance means 22 includes pincer or gripping head means 40, a support arm 42 and a drive mechanism 44. The pincer means 40 may be of the type described in the U.S. Pat. No. 4,444,384 granted to John H. Keeton entitled "PICK-UP AND FOLDING HEAD" the full disclosure of which is incorporated herein by reference. Suffice it to say, the pincer means may include spring biased jaws 46 and 48 (FIG. 2). The jaws are movable toward and away from one another in a substantially horizontal plane and are capable of holding a workpiece portion therebetween. The jaws are automatically operated.

In the preferred embodiment, and as best seen in FIG. 2, the gripping head 40 is moved from a first position, shown in solid lines, overlying the first conveyance means toward the workpiece pickup point 36 whereat it seizes the workpiece from whence it moves along the predetermined pathway to a second position, shown in dotted lines, overlying the second conveyance means. During its movement, the grasping assembly 40 has both horizontal and vertical components of movement for effecting the article or workpiece transfer from one conveyor to another while concurrently folding same about itself. As is apparent, the horizontal component of movement of the gripping head extends in a direction generally parallel with the direction of the advancement of the first conveyance means.

Figure 4:
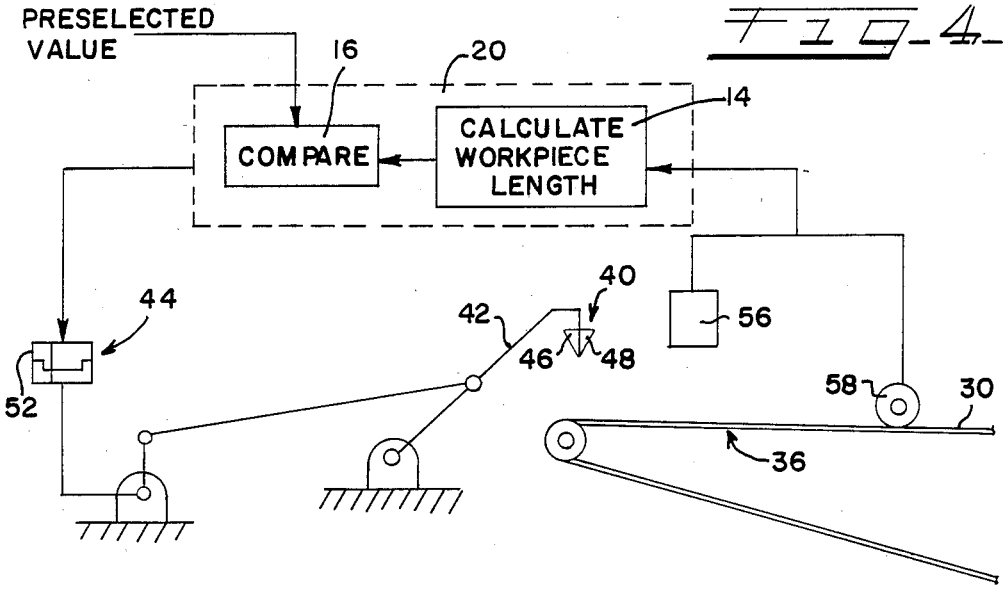
FIG. 4 is a schematic illustration of the means for controlling the movement of the workpiece along its predetermined path.

The transfer mechanism of the present invention is responsive to a control apparatus or means 20 now to be described. As fully described in the above-identified Kosrow patent application, the drive mechanism 44 for moving the pickup head assembly through the course of the cycle includes an electronically actuated clutch mechanism 52. Such a mechanism incorporates in a single control package all of the components that are necessary to accurately start and stop the arm 42 whereby ultimately positioning the pickup head means 40. The clutch mechanism 52 is responsive to the control system or computer 20. Amongst other features, the control system 20 includes an electromechanical apparatus adapted to automatically calculate the individual lengths of the workpiece being advanced along the predetermined path. Such an electromechanical device includes a first sensing device 56 disposed along the predetermined path of travel and a second apparatus or device 58. The sensing device 56 may be in the form of a photo responsive means or other suitable means capable of detecting the passage of the leading and trailing edges of the workpiece past a predetermined position. Preferably, the sensor means 56 is disposed as closely proximate the transfer mechanism 22 as possible. The other apparatus 58 includes an electromechanical encoder means capable of measuring the linear displacement of the belts comprising the first conveyance means. A Quick-Rotan part number 60.130.016 is one example of an encoding apparatus which could be used for such a purpose. As seen in FIG. 4, the outputs of both sensor means are delivered to the control system or computer 20 where they are electronically processed, as at 14, in a manner whereby calculating the workpiece length. That is, the differential linear displacement of the belts, measured by the detection signals of the leading and trailing workpiece ends received from the sensor means, calculates the workpiece length.

In accordance with a feature of the present invention, the processed workpiece length data is then electronically compared to a preselected range of sizes by any suitable software means represented generally by reference numeral 16 whose electronic circuitry could take various forms and which comprises a portion of the control apparatus 20. The important point being, the processed workpiece length data is compared to a preselected value or range of sizes. That is, the software 16 of the control apparatus 20 reads a size, preselected by the operator, which will form an acceptable workpiece; the computer or software 16 reads the workpiece length data developed by the calculation means 14; and, then the software looks at the difference between the two. The control system 20 thereafter controls the transfer mechanism as a function of that difference.

In operation, a workpiece 10 is positioned on the conveyor means 30 at the loading station 34. The conveyance means 30 moves the workpiece through the sewing station 12 which operates on the workpiece. In this embodiment, the sewing station serves to operate along the marginal edge of the workpiece. Thereafter, the leading edge of the workpiece 60 (FIG. 3) is detected by the sensor means 56. Subsequently, the trailing edge 62 (FIG. 3) of the workpiece is detected by the sensor means 56. Additionally, the linear displacement of the first conveyance means effected between the time the leading and trailing ends pass the sensor means 56 is detected by the encoder means 58. The signals of the sensor means 56 and the encoder means 58 are electronically processed in the manner described above to calculate the workpiece length of the individual workpiece being advanced towards the pickup point 36. The calculated length that is then compared to the reference value chosen by the operator. When the calculated workpiece length of a sheet falls within the preselected range of sizes chosen by the operator, the control apparatus 20 is shifted to an operative mode or condition. When the operative mode of the control apparatus is established, a signal is delivered to the clutch mechanism 52. As a result, the clutch mechanism of the driver 44 moves the gripping means 40 into contact with the workpiece and the workpiece is moved further along the predetermined path by the transference mechanism 20. On the other hand, should the calculated workpiece length lie outside of the preselected range of sizes, the control system 20 is placed in an inoperative mode or condition. As a result, no signal is delivered to the drive mechanism 44 and the transfer mechanism never effects the continuing advancement of the workpiece along the predetermined path. Instead, the conveyance means 30 continues to operate and the workpiece falls off the end thereof and is rejected. That is, the workpiece is removed from the predetermined path by ultimately falling from the end of the conveyance means 30.

Thus, there has been provided a automatic sewing apparatus which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described our invention, what we claim is:

1. A sewing apparatus comprising:

means for advancing individual sheets of material along a predetermined path of travel;

means disposed along said predetermined path of travel for automatically calculating the individual lengths of said sheets; and means for rejecting said sheets of material from said predetermined path when the length of said sheets is calculated to be outside a preselected range of sizes.

2. The invention of claim 1 wherein said automatic calculation means includes sensor means for detecting the leading and trailing edges of the material sheets and means for measuring the linear displacement of said advancing means.

3. The invention according to claim 1 wherein said advancing means includes conveyor means.

4. A sewing apparatus comprising:

means for moving individual workpieces sequentially along a predetermined path from a loading position to a second position;

stitching means disposed between said loading position and said second position for operating on said workpiece;

means for calculating the length of the individual workpieces as they are moved along the predetermined path; and means for rejecting said workpiece from said predetermined path when the length of said workpiece is calculated to be outside of a predetermined range of sizes.

5. The invention according to claim 4 wherein said moving means includes a conveyor means having a series of belts disposed along a generally horizontal path and a workpiece transfer mechanism disposed proximate the end of said conveyor means.

6. The invention according to claim 5 wherein said calculating means includes sensor means for detecting the passage thereby of the leading and trailing edges of the workpiece and means for monitoring the linear displacement of said conveyor belts.

7. The invention according to claim 5 wherein said rejection means includes means for timely impeding the action of said workpiece transfer mechanism.

8. A sewing apparatus comprising:

means for sequentially moving individual workpieces along a predetermined path from a loading position to a point whereat said workpiece is disposed for engagement by a workpiece transfer mechanism;

stitching means disposed intermediate said loading position and said engagement position for operating on the workpiece;

means for calculating the length of the sewn workpiece; and means for preventing said workpiece from being engaged by said workpiece transfer mechanism when the length of said workpiece is calculated to be outside a preselected range of sizes.

9. A sewing system comprising:

a sewing machine adapted to operate on a workpiece;

movable support surface means including a first workpiece conveyor means capable of carrying a workpiece past said sewing machine to a workpiece pickup point along a predetermined pathway;

a second workpiece conveyor means for sequentially engaging and moving individual workpieces from the workpiece pickup point to a location disposed further along the predetermined pathway; and control means responsive to workpiece length calculation means and operable between a first condition in which said second workpiece conveyor means engages a workpiece moved to the workpiece pickup point and moves same further along the predetermined pathway and a second condition in which said second workpiece conveyor means is ineffective to move a workpiece further along the predetermined pathway, the condition of said control means being determined by said workpiece length calculation means.

10. The sewing system according to claim 9 wherein a workpiece is automatically removed from the predetermined pathway when said second workpiece conveyor means is ineffective.

11. A method of sewing a workpiece comprising the steps of:

moving workpieces one after another along a predetermined path of travel;

sewing along the marginal edge of each workpiece as it is moving;

calculating the length of each workpiece as it is moved along the predetermined path; and rejecting said workpiece from said predetermined path when the calculated length thereof is outside a predetermined range of sizes.

12. A method of sewing a workpiece comprising the steps of:

advancing individual workpieces along a predetermined path of travel;

sewing on each workpiece as it moves;

calculating the length of the workpiece as it moves along its predetermined path; and rejecting said workpieces from said predetermined path when the calculated length thereof is outside a preselected range of measured sizes.

* * * * *